US005481238A

United States Patent [19]

Carsten et al.

[11] Patent Number: 5,481,238

[45] Date of Patent: Jan. 2, 1996

[54] COMPOUND INDUCTORS FOR USE IN SWITCHING REGULATORS

[75] Inventors: Bruce W. Carsten, Vancouver; Christopher D. Davidson, North Vancouver, both of Canada

[73] Assignee: Argus Technologies Ltd., Burnaby, Canada

[21] Appl. No.: 229,950

[22] Filed: Apr. 19, 1994

[51] Int. Cl.[6] ..... H01F 27/24; G05F 1/24

[52] U.S. Cl. ..... 336/214; 323/259; 323/282; 336/215

[58] Field of Search ..... 323/222, 223, 323/225, 268, 272, 255, 259, 282; 336/170, 172, 180, 184, 214, 215, 220

[56] References Cited

U.S. PATENT DOCUMENTS

| | | | |
|---|---|---|---|
| 1,357,197 | 10/1920 | Brooks . | |
| 1,865,430 | 7/1932 | Borkent . | |
| 2,342,084 | 2/1944 | Lennox . | |
| 2,792,556 | 5/1957 | Oglesbee . | |
| 3,171,092 | 2/1965 | Jetter . | |
| 3,221,280 | 11/1965 | Malsbary et al. . | |
| 4,096,559 | 6/1978 | Sakurada et al. | 363/96 |
| 4,202,031 | 5/1980 | Hesler et al. | 363/97 |
| 4,245,286 | 1/1981 | Paulkovich et al. | 363/21 |
| 4,665,357 | 5/1987 | Herbert | 323/361 |
| 4,835,497 | 5/1989 | Takagai et al. | 333/177 |
| 4,910,482 | 3/1990 | Takagai et al. | 333/181 |
| 4,977,493 | 12/1990 | Smith | 363/126 |
| 5,107,151 | 4/1992 | Cambier | 307/570 |
| 5,177,460 | 1/1993 | Dhyanchand et al. | 336/12 |
| 5,227,941 | 7/1993 | Rubin | 361/18 |
| 5,307,004 | 4/1994 | Carsten | 323/222 |

OTHER PUBLICATIONS

"A New High Frequency Converter Topology", Jones et al., Apr. 1987 HFPC Proceedings pp. 211–221.

"Power Control Using a Variable Ratio Matrix Transformer", Charles B. Olsen, May 1989 HFDC, pp. 145–156.

"Design and Application of Matrix Transformers", K. Kit Sum, May 1990, pp. 160–173 HFPC Proceedings.

"Analysis of Integrated Magnetics to Eliminate Current Ripple in Switching Converters", 361–386 page, PCI Cuk et al., Apr. 1983.

"Coupled Magnetics", Seyd M. Sobhani, Oct. 1988, PCI Proceedings pp. 59–68.

"Quasi–Linear Controllable Inductor", A. S. Kislovski, Feb. 1987 IEEE pp. 267–269.

"Linear Variable Inductor in Power Processing", A. S. Kislovski, 1987 IEEE pp. 87–90.

*Primary Examiner*—Peter S. Wong
*Assistant Examiner*—Adolf Berhane
*Attorney, Agent, or Firm*—Fulwider Patton Lee & Utecht

[57] ABSTRACT

Compound inductors for use in switching regulators have two or more symmetrically coupled windings so the component size is reduced as well as a reduction in power losses compared with conventional inductors. The compound inductors may be used in buck and boost regulators. The compound inductor assembly has a first inductor with a first winding on a first magnetic core, a second inductor with a second magnetic core outside the first winding of the first inductor, and a second winding around the first winding of the first inductor and the second core. One end of the first winding and the corresponding end of the second winding is connected to a common connection such that voltages from an alternating current flowing in the first winding have the same polarity in the first winding and in the second winding.

17 Claims, 5 Drawing Sheets

COMPOUND INDUCTORS FOR USE IN SWITCHING REGULATORS

TECHNICAL FIELD

The present invention relates to switching regulators and more specifically to a compound inductor for use in a switching regulator having two or more asymmetrically coupled windings on an equivalent number of magnetic cores.

BACKGROUND ART

The market for modern switching power converters is demanding higher power levels and power densities. Meeting this demand requires that components become smaller and dissipate less power. Component size reductions generally require an increase in switching frequency while improving efficiency. At the same time electromagnetic interference (EMI) generated by the higher frequency switching of voltages and currents must be at or below prior art levels to meet federal and international requirements.

One approach to meeting these conflicting requirements is the use of various "soft switching" power converters. In one type of power converter, the voltage is brought to zero on the main switch or switches prior to turning on. When the switch is turned off, the current transfers to the junction capacity of the switch or switches or to additional capacity placed across the switch or switches to assist in reducing EMI.

In our co-pending application Ser. No. 07/909,257 filed Jul. 6, 1992, is disclosed soft switching circuits for buck and boost regulators which utilize tapped "main" inductors. In one embodiment, a small "pilot" inductor is disclosed in series with the tap of the main inductor. The use of discrete pilot and main inductors is known with the pilot inductor consisting of a single winding on a core while the main inductors consists of either a tapped winding on the core or possibly a voltage bucking winding in addition to an untapped winding to create the effect of a tap on the main winding.

The pilot inductance in our previously filed application is small compared to the main inductor and the RMS current is considerably less in the pilot inductor, although peak currents are similar. Thus, the pilot inductor is electrically smaller than the main inductor, but in practice the dimensions of the pilot inductor are comparable to those of the main inductor.

This discrepancy in relative sizes between the main inductor and the pilot inductor is at least partially due to the fact that while the main inductor current and flux are largely DC with a smaller superimposed AC component, the winding current and core flux in the pilot inductor pulse from zero to maximum and back to zero very quickly. The pulse duration is typically in the order of 5% to 10% of the switching period, which generates strong harmonics of ten or twenty times the switching frequency. Winding and core losses increase dramatically with frequency above present switching frequencies of 50 to 200 KHz, resulting in winding and core losses in the order of three to ten time higher than would be expected from the RMS current and the peak-to-peak core flux at the switching frequency.

DISCLOSURE OF INVENTION

We have now found that if the core of the main inductor is divided in two, the pilot inductor winding can be placed on one of the two cores of the main inductor inside the main inductor winding to create a compound inductor. This simultaneously provides the equivalent of a voltage tap on the main inductor with the pilot inductor in series with the voltage tap. Thus the assembly for the main and pilot inductors is substantially the same size as known types of main inductors. This results in switching regulators having compound inductors that have reduced size, weight and power losses over the use of conventional inductors.

Existing switching regulators often require two or more stages of low pass filtering on the input and/or output to meet EMI requirements while minimizing the size of the filter components. In the past this has required the use of separate inductors for each filter stage.

The present invention allows two or more low pass filter inductors to be combined within the same compound inductor construction resulting in size, weight and power loss reductions over the use of two or more discrete inductors.

The present invention provides a compound inductor assembly comprising a first inductor having a first winding on a first magnetic core; a second inductor having a second magnetic core outside the first winding of the first inductor, and a second winding around the first winding of the first inductor and the second core; one end of the first winding and the corresponding end of the second winding connected to a common connection such that voltages induced in the first winding and the second winding from an alternating current flowing in the first winding have the same polarity.

In one embodiment of the invention, the soft switching pilot or first inductor in buck and boost regulators is combined with the main or second inductor in a single compound inductor assembly. The core of the main inductor is divided in two, and the pilot inductor winding which has fewer turns than the main winding, is placed on one of the two cores of the main inductor, this simultaneously provides the pilot inductance and the equivalence of a voltage tap on the main inductor.

In a further embodiment the first and second stage filter inductors of a switching regulator low pass filter are combined in a single compound inductor assembly, in which the first and second inductor windings have the same number of turns.

In a still further embodiment the second winding has slightly fewer turns than the first winding. This embodiment creates a resonant notch in the high frequency attenuation characteristic of the low pass filter.

Yet a further embodiment combines three windings and three cores in a compound inductor rather than two windings and two cores. In all of the embodiments disclosed, the several cores need not be of the same size, nor of the same magnetic material or effective permeability. In some of the multi-stage filter embodiments, for example, a ferrite core may be used for the first or main inductor core to minimize hysteresis losses while laminated silicon steel may be used for the pilot or second inductor core with a higher effective permeability to increase inductance.

BRIEF DESCRIPTION OF DRAWINGS

In drawings which disclose the present invention.

MODES FOR CARRYING OUT THE INVENTION

Figure 1:
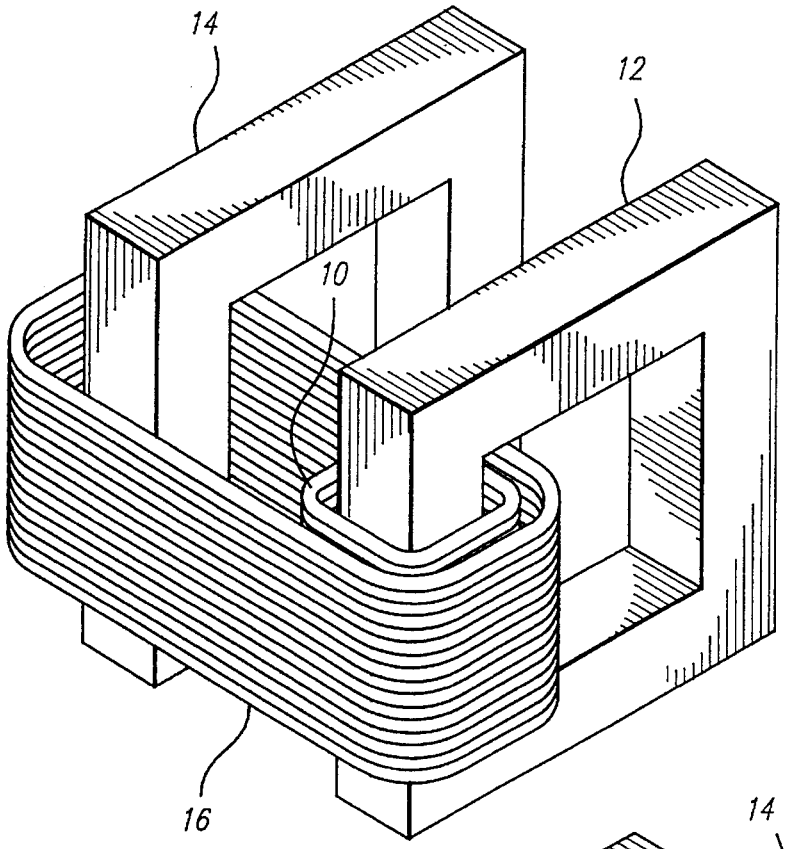
FIG. 1 is an isometric view showing a compound inductor assembly having two windings and two cores.

A compound inductor of the present invention has asymmetrical coupled windings and multiple magnetic cores. FIG. 1 illustrates a first winding 10 on a first magnetic core 12 and a second magnetic core 14 outside the first winding 10 and having a second winding 16 around the first winding 10 and the first core 12 and also the second core 14. In this configuration the degree of magnetic flux coupling between the windings is asymmetrical in the sense that virtually all of the flux generated by a current in the first winding 10 is encompassed by the second winding 16, but only a portion of the flux generated by a current in the second winding is encompassed by the first winding 10.

A changing current in the first winding 10 generates a corresponding change in the flux in the first core 12 which results in a voltage across the first winding 10 equal to the winding inductance times the rate of change of current. A voltage is also generated on the second winding 16 with the same "volts per turn" as the first winding 10 since the same flux is encompassed by both windings.

A current in the second winding 16 produces a flux in both the first core 12 and the second core 14. Only the flux in the first core 12 is encompassed by the first winding 10, thus a changing current in the second winding 16 generates a lesser "volts per turn" on the first winding 10 than on the second winding 16, as only a portion of the total flux is encompassed by the first winding 10. Thus, the flux coupling is termed "asymmetric". Furthermore, the changing current flowing in the first winding 10 and the second winding 16 both have the same polarity.

Figure 2:
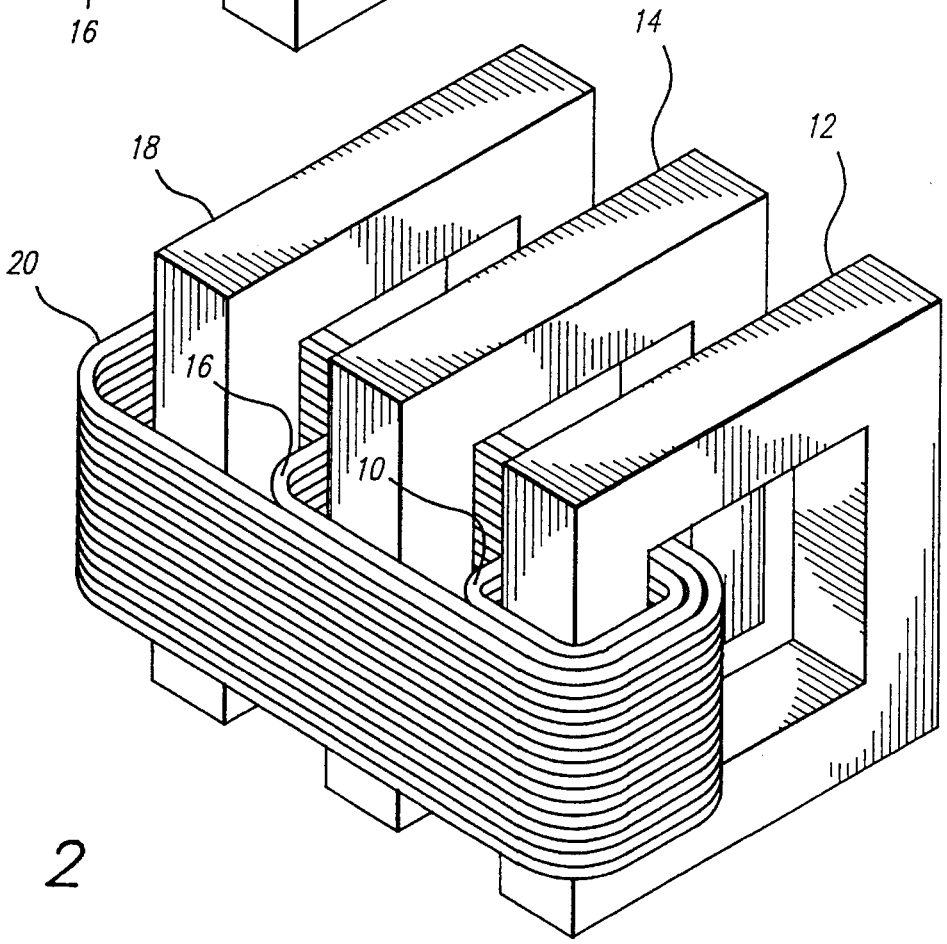
FIG. 2 is an isometric view showing a compound inductor assembly having three windings and three cores.

FIG. 2 illustrates an extension to FIG. 1 with a third magnetic core 18 positioned outside the second winding 16 and a third winding 20 which extends around the first and second windings 10,16 and the first, second and third cores 12,14,18.

Cores of transformers typically have high permeability and are used to minimize energy storage and excitation currents. Inductors in some embodiments are designed to provide a high impedance to alternating currents or to store energy. Inductors designed for maximum impedance like transformers utilize high permeability cores in order to maximize inductance.

Inductors designed for energy storage have cores of moderate permeability. High permeability cores magnetically saturate with relatively little current in the winding, and the energy storage is low. However, the magnetic field in "air cored" inductors is low when the winding is carrying the maximum current without overheating. This results in low energy storage.

Maximum energy storage is achieved with simultaneous maximum winding current (a thermal limit) and core flux density (saturation or loss limited). This typically requires cores with effective permeabilities between ten and a few hundred, as opposed to unity for air and 1,000 to 100,000 for ungapped magnetic materials. These intermediate permeabilities are achieved with one or more discrete "air gaps" in a high permeability core, or with a "distributed gap" material, often referred to generically as "powdered iron".

For the present invention, the compound inductors are of the energy storage type, the cores are of moderate effective permeability utilizing one or more discrete air gaps or a distributed gap material.

Figure 3:
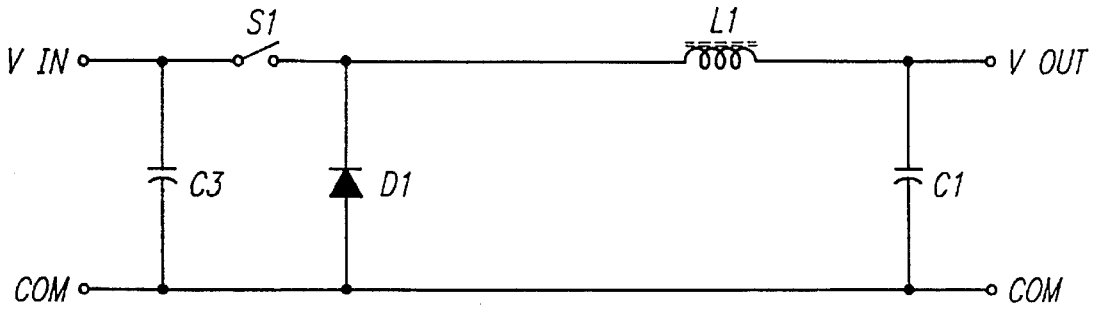
FIG. 3 PRIOR ART
FIG. 3 is a schematic diagram showing a buck regulator circuit known in the prior art.
Figure 4:
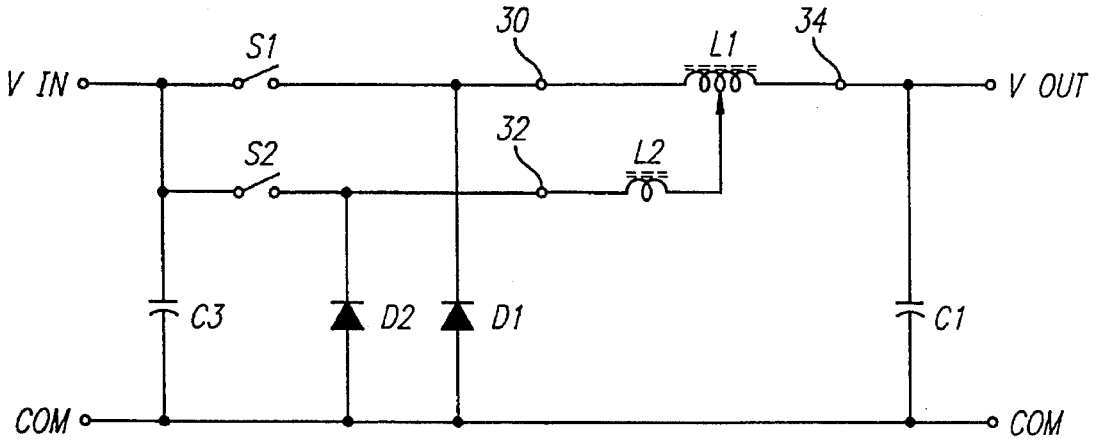
FIG. 4 is a schematic diagram showing a soft switching buck regulator as disclosed in co-pending application Ser. No. 07/909,257 (now U.S. Pat. No. 5,307,004)

A basic schematic diagram of a prior art switching buck regulator is shown FIG. 3. A soft-switching buck regulator as disclosed in co-pending application Ser. No. 07/909,257 (U.S. Pat. No. 5,307,004) is shown in FIG. 4. Whereas a buck regulator is disclosed herein, it will be understood that a buck regulator becomes a boost regulator when active switches are replaced with diodes, and diodes are replaced with active switches. Thus, the direction of current and power flow is reversed. In the case of FIG. 3, the circuit becomes a boost regulator when S1 and D1 are interchanged and in the case of FIG. 4, the circuit becomes a boost regulator when S1 and S2 are interchanged with D1 and D2 respectively.

Figure 5:
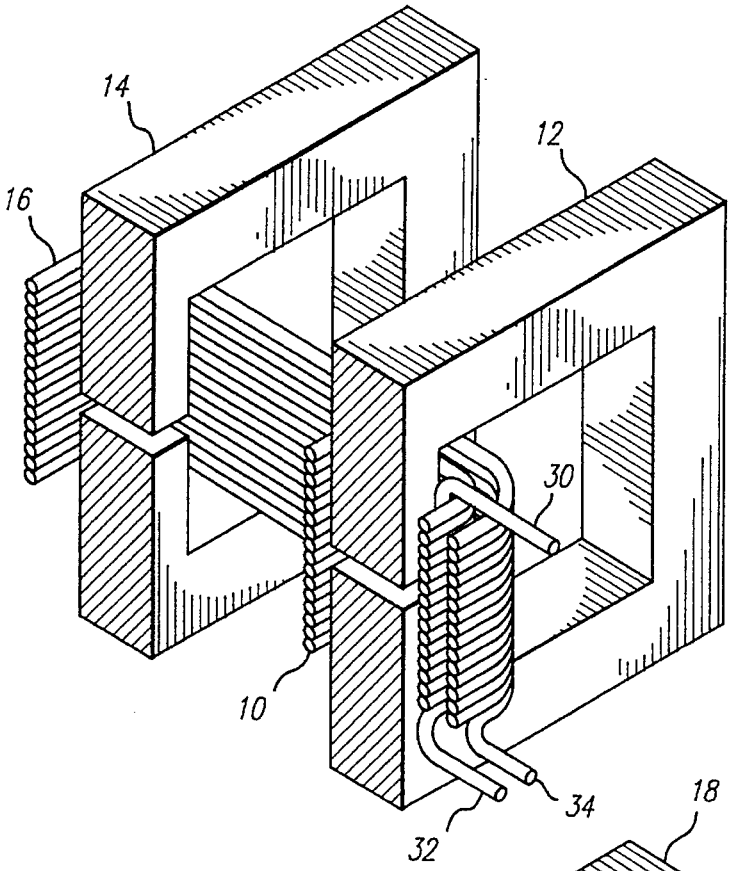
FIG. 5 is a cutaway isometric view showing the compound inductor assembly of FIG. 1 with the air gaps in the cores and the connections to the windings visible.
Figure 7:
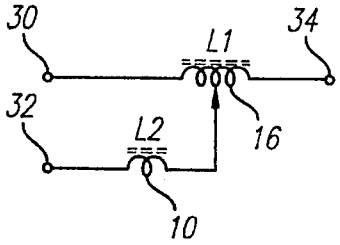
FIG. 7 is a simplified schematic diagram showing a compound inductor assembly according to one embodiment of the present invention when the first winding has substantially fewer turns than the second winding.

In the embodiment shown in FIG. 7, the first winding 10 (pilot inductor) is tapped into the second winding 16 (main inductor) of a soft switching regulator. The connections are similar to that shown in FIG. 5. The first winding 10 extends from a common connection terminal 30 to the other end terminal 32 of the first winding 10. The second winding 16 extends from common connector terminal 30 to the other end terminal 34 of the second winding 16. The inductance L1 between terminals 30 and 34 shown in FIG. 7 is the inductance of the second winding 16 with the first winding 10 open circuited. This is the same as the inductance of the second winding 16 with both cores in place. The effective inductance L2 in series with the tap is the inductance observed between terminals 30 and 32 with the second winding 16 short circuited and is typically less than the inductance L1.

This inductor arrangement is used in soft switching buck and boost regulators of the type illustrated in FIG. 4. Switch S2, diode D2, and pilot inductor L2 are added to a buck regulator of the type shown in FIG. 3 as well as the usual capacitors C1 and C3. Closing S2 in FIG. 4 brings the voltage on switch S1 to zero before S1 turns on, thus reducing switching losses. The energy stored in L2 is returned to the output through D2 by turning S2 off after S1 turns on.

The compound inductor of the present invention reduces the total inductor size and power losses. Inductor L2 operates with a high pulse current and core flux and the attendant core and winding losses may cause a discrete inductor to be over sized and not much smaller than L1 physically, although much smaller in inductance. Utilizing part of the relatively large L1 core for L2 reduces the number of turns required for the pilot inductance (first winding 10), and thus also reduces the conductor losses due to the pulse current.

At the same time the pulse flux in the core is reduced by the small number of pilot inductor turns (first winding 10), which minimize the core loss. The main inductor (second winding 16) typically generates negligible core hysteresis loss due to the moderate AC current component. The core flux is principally saturation limited by the DC current plus half the peak-to-peak AC ripple current. The additional core loss due to the pulse flux typically requires no increase in the required main inductor core size. Thus, total winding and core losses are reduced in an assembly that is little larger than L1 alone.

Figure 8:
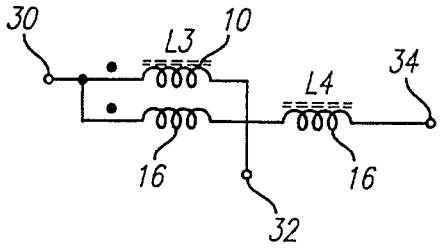
FIG. 8 is a schematic diagram showing a compound inductor assembly according to another embodiment of the present invention when the first winding has the same number of turns as the second winding.

In another embodiment, the first and second stage filter inductors of the switching regulator low pass filter are combined in a single compound inductor assembly in which the first and second inductor windings have the same number of turns. The configuration of this embodiment is similar to that shown in FIGS. 1 and 5, thus the voltages on the two windings are of the same polarity. The circuit illustrated in FIG. 8 shows the common connection terminal 30 with the first winding 10 extending to connection terminal 32 and the second winding 16 extending in two halves to connection terminal 34. The inductance L3 observed between terminals 30 and 32 is the inductance of the first winding 10 with the second winding 16 open circuited. This is the same as that of the first winding 10 and the first core alone. The inductance L4 between terminals 32 and 34 is the inductance of the second winding 16 with the first winding 10 short circuited. This is the same as the inductance of the second winding 16 and second core alone.

The voltages on the two windings of inductance L3 are identical in this case, so inductance L4 is effectively connected between terminals 32 and 34. The equivalent circuit of FIG. 8 may be replaced by the simplified equivalent circuit of FIG. 9.

Figure 10:
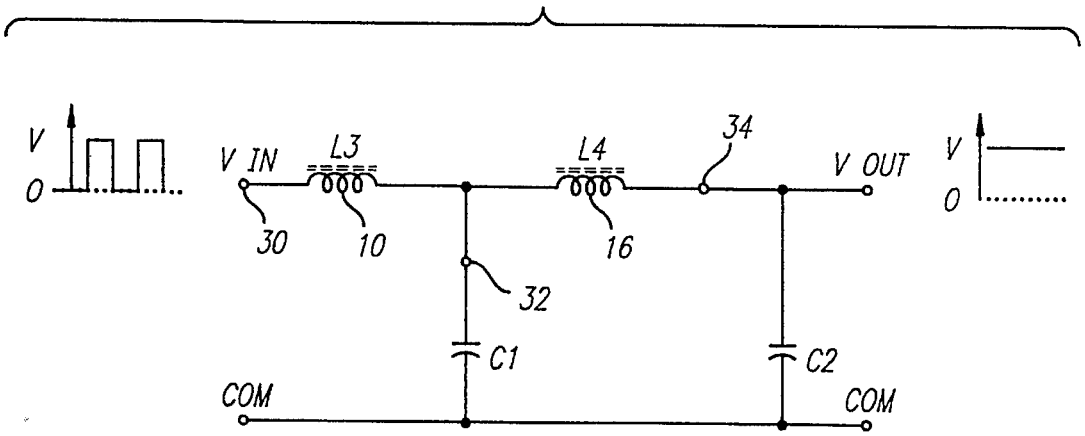
FIG. 10 is a schematic diagram showing the compound inductor of FIG. 9 in a two stage low pass filter.

FIG. 10 shows the resultant equivalent of two inductors in series as used in a two stage inductor capacitor low pass filter. The second capacitor C2 may not be essential. In the output of a buck regulator, AC ripple is filtered from a unipolar pulse voltage with the average DC voltage at the output. This is illustrated in the left and right graphs of FIG. 10. Virtually all of the high frequency AC current flows in the first winding 10 from terminal 30 to terminal 32 and to a first condenser C1 while DC and low frequency currents flow in the second winding 16 to the output terminal 34. Since the first winding 10 carries only the AC ripple current, a smaller wire gauge (or thinner foil) than the second winding 16 can be used. The compound inductor may also be used on the input of the buck regulator, or in the input or output of boost or isolated regulators for additional filtering.

The compound inductor shown in FIG. 10 has advantages over inductors with separate windings and cores in that reduction in overall physical size is achieved and also reduction occurs in DC conductor losses in the second winding 16. These advantages are both due to the longer total winding length which would have to wrap around the two cores individually if they were used in the conventional and known type of inductors.

Figure 11:
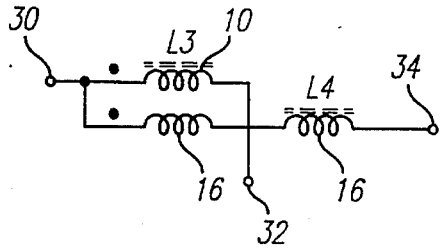
FIG. 11 is a schematic diagram showing a compound inductor assembly according to a further embodiment of the present invention when the first winding has slightly more turns than the second winding.

A further embodiment as shown in FIG. 11 is similar to the embodiment shown in FIG. 8 except the first winding 10 has at least one more turn than the second winding 16. The AC voltage on the second winding 16 is now slightly lower than on the first winding 10 which makes it appear that the second inductance L4 in the equivalent circuit is connected to a tap on the first inductance L3 as shown in FIG. 12.

Figure 13:
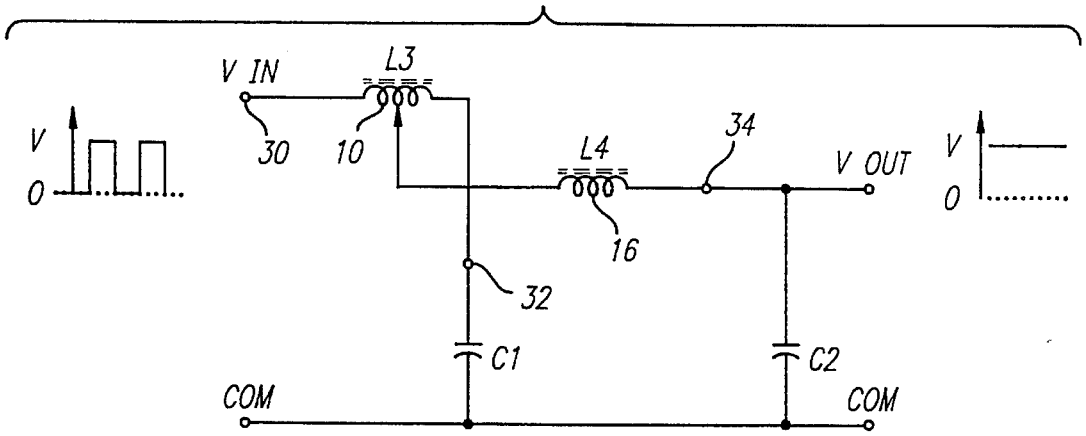
FIG. 13 is a schematic diagram showing the compound inductor of FIG. 12 in a two stage low pass filter with a resonant notch.

When used in a low pass filter, the circuit of FIG. 13 results. The voltage between terminal 32 and the tap of L3 is of opposite phase to the voltage on capacitor C1. At some point above the low pass corner frequency, the voltages on the tap and C1 cancel, creating the effect of a resonant notch in the attenuation characteristic. This effect is useful in removing a strong undesirable fixed frequency component, such as the fundamental frequency of the pulse input voltage.

Figure 9:
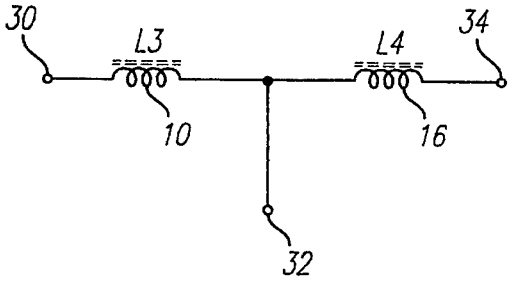
FIG. 9 is a schematic diagram showing a simplification of the diagram of FIG. 8.
Figure 12:
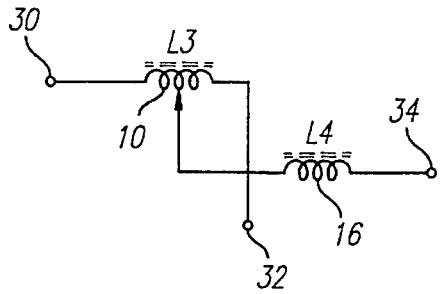
FIG. 12 is a schematic diagram showing a simplification of the diagram of FIG. 11.

The advantage of the embodiment shown in FIGS. 11 to 13 are similar to those of the embodiment shown in FIGS. 8 to 10 with the additional advantage of the resonant notch in the high frequency attenuation.

Figure 6:
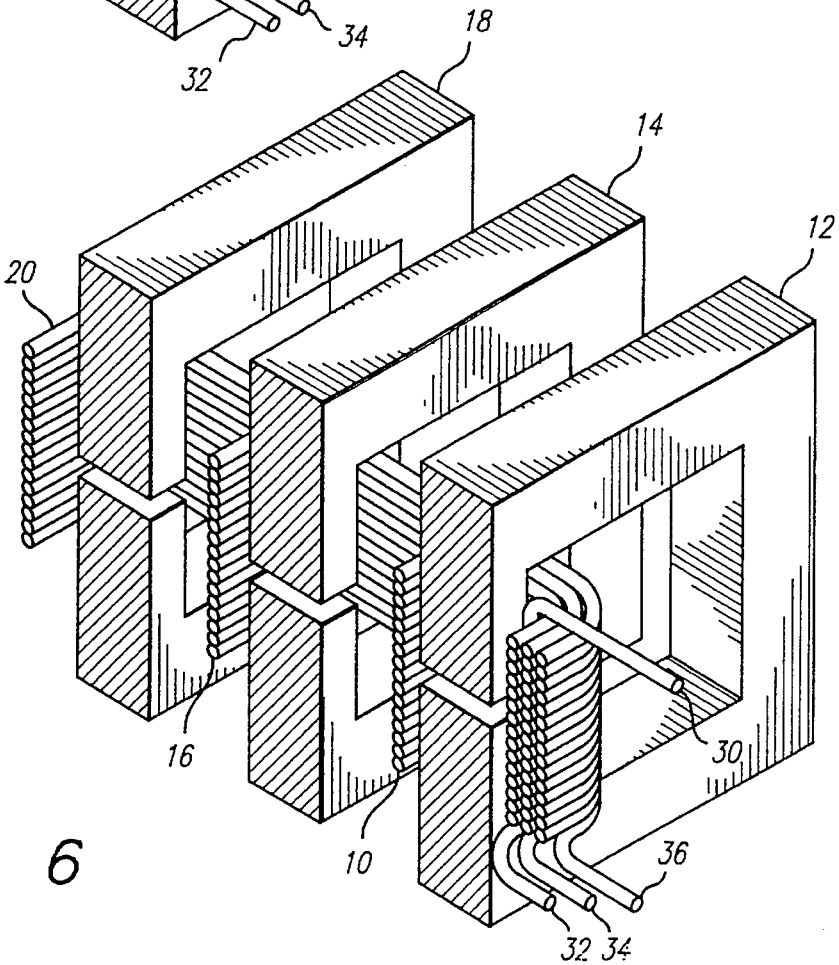
FIG. 6 is a cutaway isometric view showing the compound inductor assembly of FIG. 2 with the air gaps in the cores and the connections to the windings visible.
Figure 14:
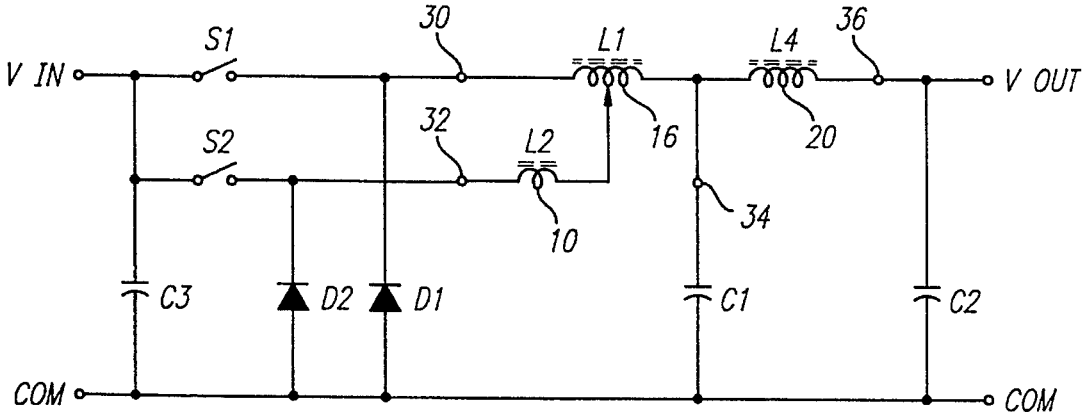
FIG. 14 is a schematic diagram showing a switch buck regulator with a compound inductor assembly combining the inductor assemblies of FIG. 7 and FIG. 8.

A still further embodiment is shown in FIG. 14 which combines the embodiment shown in FIGS. 8 to 10 and the embodiment shown in FIGS. 11 to 13, having three windings and three cores as illustrated in FIGS. 2 and 6. The common connection terminal 30 is shown connecting through the first winding 10 to the other end terminal 32 through the second winding 16 to the other end terminal 34 and through the third winding 20 to the other end terminal 36. The first winding 10 has fewer turns than the second winding 16, and the third winding 20 has at least the same number of turns as the second winding 16. A soft switching buck regulator utilizing this embodiment is shown in FIG. 14. The main inductor is L1, the pilot inductor is L2 for soft switching, and L4 is the second stage output filter inductor. The same compound inductor can be used in a soft switching boost regulator by exchanging the positions of S1 and D1 and S2 with D2.

Various changes may be made to the embodiments shown herein without departing from the scope of the present invention which is limited only by the following claims.

The embodiments of the present invention in which an exclusive property or privilege is claimed are defined as follows:

1. A compound inductor assembly wherein the inductor is an energy storage type, comprising:

a first inductor having a first winding on a first magnetic core;

a second inductor having a second magnetic core outside the first winding of the first inductor, and a second winding around the first winding of the first inductor and the second core;

one end of the first winding and the corresponding end of the second winding connected to a common connection such that voltages induced in the first winding and the second winding from an alternating current flowing in the first winding have the same polarity.

2. The compound inductor assembly according to claim 1 wherein the first winding has fewer turns than the second winding.

3. The compound inductor assembly according to claim 1 wherein the first winding has the same number of turns as the second winding.

4. The compound inductor assembly according to claim 1 wherein the first winding has at least one more turn than the second winding.

5. The compound inductor assembly according to claim 1 including a third inductor having a third magnetic core outside the second winding of the second inductor, and a third winding around the second winding of the second inductor and the third core, one end of the third winding connected to the common connection of the first winding and the second winding such that voltages induced in the first winding, second winding and third winding from an alternating current flowing in the first winding, have the same polarity.

6. The compound inductor assembly according to claim 5 wherein the first winding has fewer turns than the second winding, and the third winding has at least the same number of turns as the second winding.

7. A soft switching buck regulator comprising:

a first energy storage type inductor having a first winding on a first magnetic core;

a second energy storage type inductor having a second magnetic core outside the first winding of the first inductor, and a second winding around the first winding of the first inductor and the second core, the first winding having fewer turns than the second winding;

one end of the first winding and the corresponding end of the second winding connected to a common connection;

an input terminal connected to the common connection through a first controllable switch means;

a second controllable switch means connected between the input terminal and the other end of the first winding;

an output terminal connected to the other end of the second winding;

a common voltage line connected to the common connection through a first passive switch means;

a second passive switch means connected between the common voltage line and the other end of the first winding, and a first capacitor connected between the input terminal and the common voltage line.

8. The soft switching buck regulator according to claim 7 including a second capacitor connected between the output terminal and the common voltage line.

9. A soft switching boost regulator comprising:

a first energy storage type inductor having a first winding on a first magnetic core;

a second energy storage type inductor having a second magnetic core outside the first winding of the first inductor, and a second winding around the first winding of the first inductor and the second core, the first winding having fewer turns than the second winding;

one end of the first winding and the corresponding end of the second winding connected to a common connection;

an output terminal connected to the common connection through a first passive switch means;

a second passive switch means connected between the output terminal and the other end of the first winding;

an input terminal connected to the other end of the second winding;

a common voltage line connected to the common connection through a first controllable switch means;

a second controllable switch means connected between the common voltage line and the other end of the first winding, and a first capacitor connected between the output terminal and the common voltage line.

10. The soft switching boost regulator according to claim 9 including a second capacitor connected between the input terminal and the common voltage line.

11. A two stage switching buck regulator output filter or boost regulator input filter comprising:

a first energy storage type inductor having a first winding on a first magnetic core;

a second energy storage type inductor having a second magnetic core outside the first winding of the first inductor and a second winding around the first winding of the first inductor and the second core, the first winding having substantially the same number of turns as the second winding;

one end of the first winding and the corresponding end of the second winding connected to a common connection;

a filter input terminal connected to the common connection;

a common voltage line connected to the other end of the first winding through a first capacitor;

a filter output terminal connected to the other end of the second winding, and a second capacitor connected between the filter output terminal and the common voltage line.

12. A two stage switching buck regulator input filter or boost regulator output filter comprising:

a first energy storage type inductor having a first winding on a first magnetic core;

a second energy storage type inductor having a second magnetic core outside the first winding of the first inductor, and a second winding around the first winding of the first inductor and the second core, the first winding having substantially the same number of turns as the second winding;

one end of the first winding and the corresponding end of the second winding connected to a common connection;

a filter input terminal connected to the common connection;

a common voltage line connected to the other end of the first winding through a first capacitor;

a filter output terminal connected to the other end of the second winding, and a second capacitor connected between the filter input terminal and the common voltage line.

13. A two stage switching buck regulator output filter or boost regulator input filter comprising:

a first energy storage type inductor having a first winding on a first magnetic core;

a second energy storage type inductor having a second magnetic core outside the first winding of the first inductor, and a second winding around the first winding of the first inductor and the second core, the first winding having at least one more turn than the second winding;

one end of the first winding and the corresponding end of the second winding connected to a common connection;

a filter input terminal connected to the common connection;

a common voltage line connected to the other end of the first winding through a first capacitor;

a filter output terminal connected to the other end of the second winding, and a second capacitor connected between the filter output terminal and the common voltage line.

14. A two stage switching buck regulator input filter or boost regulator output filter comprising:

a first energy storage type inductor having a first winding on a first magnetic core;

a second energy storage type inductor having a second magnetic core outside the first winding of the first inductor, and a second winding around the first winding of the first inductor and the second core, the first winding having at least one more turn than the second winding;

one end of the first winding and the corresponding end of the second winding connected to a common connection;

a filter input terminal connected to the common connection;

a common voltage line connected to the other end of the first winding through a first capacitor;

a filter output terminal connected to the other end of the second winding, and a second capacitor connected between the filter input terminal and the common voltage line.

15. A soft switching buck regulator comprising:

a first energy storage type inductor having a first winding on a first magnetic core;

a second energy storage type inductor having a second magnetic core outside the first winding of the first inductor, and a second winding around the first winding of the first inductor and the second core, the first winding having fewer turns than the second winding;

a third energy storage type inductor having a third magnetic core outside the second winding of the second inductor, and a third winding around the second winding of the second inductor and the third core, the third winding having substantially the same number of turns as the second winding;

one end of the first winding, and the corresponding ends of the second winding and the third winding connected to a common connection;

an input terminal connected to the common connection through a first controllable switch means;

a second controllable switch means connected between the input terminal and the other end of the first winding;

a common voltage line connected to the other end of the second winding through a first capacitor;

an output terminal connected to the other end of the third winding;

a first passive switch means connected between the common connection and the common voltage line;

a second passive switch means connected between the other end of the first winding and the common voltage line;

a second capacitor connected between the output terminal and the common voltage line, and a third capacitor connected between the input terminal and the common voltage line.

16. A soft switching boost regulator comprising:

a first energy storage type inductor having a first winding on a first magnetic core;

a second energy storage type inductor having a second magnetic core outside the first winding of the first inductor, and a second winding around the first winding of the first inductor and the second core, the first winding having fewer turns than the second winding;

a third energy storage type inductor having a third magnetic core outside the second winding of the second inductor, and a third winding around the second winding of the second inductor and the third core, the third winding having substantially the same number of turns as the second winding;

one end of the first winding, and the corresponding ends of the second winding and the third winding connected to a common connection;

an output terminal connected to the common connection through a first passive switch means;

a second passive switch means connected between the output terminal and the other end of the first winding;

a common voltage line connected to the other end of the second winding through a first capacitor;

an input terminal connected to the other end of the third winding;

a first controllable switch means connected between the common connection and the common voltage line;

a second controllable switch means connected between the other end of the first winding and the common voltage line;

a second capacitor connected between the output terminal and the common voltage line, and a third capacitor connected between the input terminal and the common voltage line.

17. A compound inductor assembly comprising:

a first inductor having a first winding on a first magnetic core;

a second inductor having a second magnetic core outside the first winding of the first inductor, and a second winding around the first winding of the first inductor and the second core;

one end of the first winding and the corresponding end of the second winding connected to a common connection such that voltages induced in the first winding and the second winding from an alternating current flowing in the first winding have the same polarity; and said first and second magnetic cores each including at least one of a discrete air gap and a distributed gap material.

* * * * *